US008695933B2

(12) United States Patent
Gennaretti et al.

(10) Patent No.: US 8,695,933 B2
(45) Date of Patent: Apr. 15, 2014

(54) ADJUSTABLE FOOT, IN PARTICULAR A REAR FOOT, FOR AN ELECTRIC HOUSEHOLD APPLIANCE

(75) Inventors: Luca Gennaretti, Rivoli (IT); Pierluigi Carli, Gassino Torinese (IT)

(73) Assignee: Illinois Tool Works Inc., Glenview, IL (US)

( * ) Notice: Subject to any disclaimer, the term of this patent is extended or adjusted under 35 U.S.C. 154(b) by 153 days.

(21) Appl. No.: 13/201,682

(22) PCT Filed: Feb. 16, 2010

(86) PCT No.: PCT/US2010/024249

§ 371 (c)(1),
(2), (4) Date: Aug. 16, 2011

(87) PCT Pub. No.: WO2010/096364

PCT Pub. Date: Aug. 26, 2010

(65) Prior Publication Data

US 2011/0297802 A1 Dec. 8, 2011

(30) Foreign Application Priority Data

Feb. 17, 2009 (IT) ..... TO2009A0114

(51) Int. Cl.
*F16M 11/24* (2006.01)

(52) U.S. Cl.
USPC ..... 248/188.4; 248/188.2

(58) Field of Classification Search
USPC ..... 248/188.2, 188.4, 188.8, 188.9, 649, 248/677; 312/351.3; 108/146, 147, 144.11
See application file for complete search history.

(56) References Cited

U.S. PATENT DOCUMENTS

| | | | | |
|---|---|---|---|---|
| 4,991,805 | A * | 2/1991 | Solak et al. | 248/188.4 |
| 5,292,095 | A * | 3/1994 | Cattaneo | 248/188.4 |
| 6,729,590 | B2 * | 5/2004 | Gabriel | 248/188.2 |
| 8,220,760 | B2 * | 7/2012 | Fetzer et al. | 248/188.4 |
| 2003/0136887 | A1 | 7/2003 | Gabriel | |
| 2004/0206196 | A1 | 10/2004 | Gabriel | |

FOREIGN PATENT DOCUMENTS

| | | | |
|---|---|---|---|
| DE | 202004017329 | U1 | 3/2006 |
| EP | 1895040 | A1 | 3/2008 |

OTHER PUBLICATIONS

International Search Report for PCT/US2010/024249 mailed May 27, 2010.
Italian Search Report for TO2009A000114 dated Oct. 2, 2009.

* cited by examiner

*Primary Examiner* — Alfred J Wujciak

(57) ABSTRACT

An adjustable foot for an electric household appliance having a body integrally fastenable to a casing of the electric household appliance, a stem carried by the body so as to vertically slide, a support element associated with a lower end of the stem, a first screw mechanism operatively associated with the stem and provided with anti-rotation portion cooperating with the body, a toothed wheel carried by the body so as to be coaxial to the stem and idle about a substantially vertical symmetry axis of the latter, a second screw mechanism operatively associated with the toothed wheel and cooperating with the first screw mechanism for vertically translating the stem in response to a rotation of the toothed wheel.

10 Claims, 2 Drawing Sheets

ADJUSTABLE FOOT, IN PARTICULAR A REAR FOOT, FOR AN ELECTRIC HOUSEHOLD APPLIANCE

RELATED APPLICATIONS

The present application is a National Phase of International Application Number PCT/US2010/024249, filed Feb. 16, 2010 and claims priority from, Italian Application Number TO2009A000114, filed Feb. 17, 2009.

TECHNICAL FIELD

The present invention relates to an adjustable foot, in particular a rear foot, for an electric household appliance. Such a type of foot is usually used in electric household appliances, especially of the fitted type, such as washing machines and/or dishwashers, for both levelling the electric household appliance and possibly moving it, e.g. for maintenance interventions or cleaning.

BACKGROUND ART

An adjustable foot is known from EP-A-1895040, for example, in which a stem provided with floor resting means and an external threading meshes with a nut screw obtained inside a toothed wheel, which is rotationally actuated by a worm screw which is controllable by the user. Such a type of height-adjustment device for the foot has the problem of managing the stroke-end, when the foot is raised; indeed, the foot is usually arranged behind the electric household appliance but is controlled from the front, e.g. by means of a tool inserted through a hole of the front panel, whereby it may not be seen. Sticking or damages to the thread may occur if the user applies a torque on the worm screw at the stroke-end, without considering the excessive effort required by the user when manoeuvring. In order to allow the thread to slip to a stroke-end position, a nut screw consisting of two or more half-elements held together by a spring has been suggested. However, such a solution is complex, cumbersome and requires the user to apply a high torque for controlling the worm screw.

DISCLOSURE OF INVENTION

It is an object of the present invention to solve the aforesaid problem by providing a height-adjustable foot for an electric household appliance which has a simple, cost-effective construction, is small in size, very reliable, and which allows to obtain a slipping at the stroke-end when lifting the foot, which avoids the thread from being forced by applying extra-torque on the worm screw by the user, which is minimum and in all cases much less than that needed in the known solutions.

The present invention thus relates to an adjustable foot for an electric household appliance, as defined in claim 1.

In particular, the foot according to the invention comprises a body integrally fastenable to a casing of the electric household appliance, a stem carried by the body so as to vertically slide, floor resting means associated with a lower end of the stem, first screw means operatively associated with the stem and provided with anti-rotation means cooperating with the body, a toothed wheel carried by the body so as to be coaxial to the stem and idle about a substantially vertical symmetry axis of the latter, second screw means operatively associated with the toothed wheel and cooperating with the first screw means for vertically translating the stem in response to a rotation of the toothed wheel, and control means for the toothed wheel.

According to an aspect of the invention, the toothed wheel is axially mounted with a clearance between opposite first and second abutting means of the body, which is provided with elastic axial biasing means cooperating with the toothed wheel and arranged at the first abutting means; the latter face towards an end length of the first screw means having a thread height gradually decreasing towards the elastic axial biasing means.

The extent of the axial clearance for assembling the toothed wheel between the first and second abutting means is substantially equal to the length, measured in the axial direction, of the end length of the first screw means.

The elastic axial biasing means preferably consist of at least one elastically deformable tooth integrally formed in one piece with the body, which is made of synthetic plastic material, which tooth transversally extends so as to protrude with respect to the symmetry axis of the stem, within respective seats for accommodating the stem and the toothed wheel, obtained inside the body; the at least one elastically deformable tooth is shaped so that, under undeformed conditions, it interferes with the toothed wheel so as to keep the same in contact against the second abutting means.

Thereby, when the stroke-end position is reached, i.e. when the second screw means associated with the toothed wheel mesh with the end length of the first screw means, associated with the stem, the toothed wheel which is normally held by the elastic axial biasing means against the second abutting means, is pushed by the "unscrewing" action of the end length of the first screw means against the first abutting means, thus straining the elastic axial biasing means, which react with an axial stress which pushes the toothed wheel back towards the second abutting means; the thread height of the end length of the first screw means being progressively decreasing towards the first abutting means and the elastic axial biasing means associated therewith, if the user continues actuating the toothed wheel, it "slips" on the stem with minimum increase of torque to be exerted by the user, because it corresponds to the elastic deformation force of the elastic axial biasing means only, which is also minimum because the axial elastic stress which they should exert on the toothed wheel is the only one which allows the screw means associated with the toothed wheel to return to mesh the lowered thread of the end length of the screw means associated with the stem as soon as "unscrewing" is completed, with consequent ceasing of the axial bias on the toothed wheel by the stem.

BRIEF DESCRIPTION OF THE DRAWINGS

Further features and advantages of the present invention will become apparent from the following description of a preferred embodiment thereof, merely provided by way of non-limitative example, with reference to the accompanying drawings, in which.

BEST MODE FOR CARRYING OUT THE INVENTION

Figure 1:
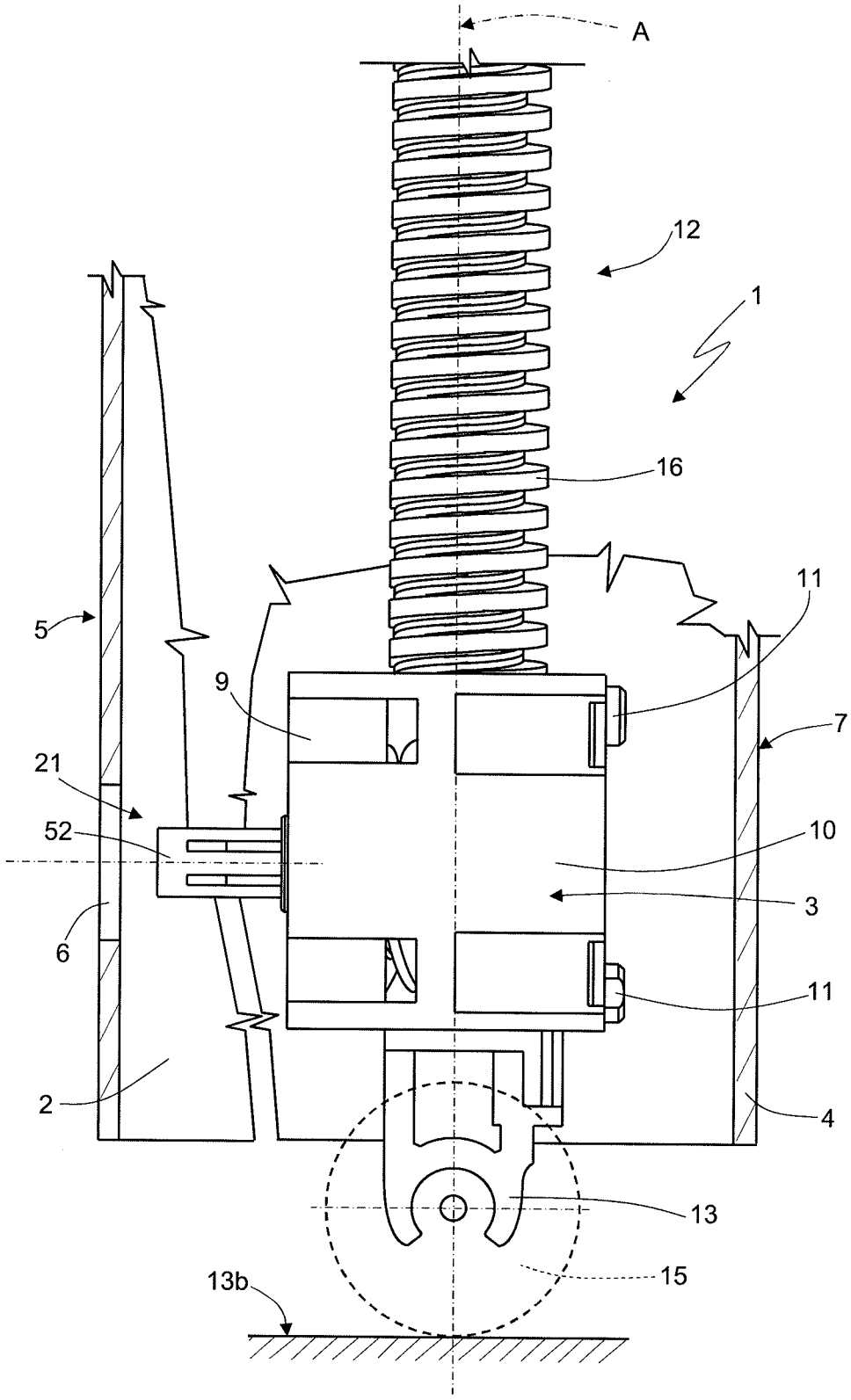
FIG. 1 diagrammatically shows an elevation view of an adjustable foot for an electric household appliance provided according to the invention.

With reference to figures from 1 to 4, numeral 1 indicates as a whole an adjustable foot for an electric household appliance 2, in particular a rear foot for a fitted washing machine or dishwasher.

Foot 1 comprises a body 3 integrally fastenable to a casing 4 of the electric household appliance, which has a front panel 5 provided with a hole 6 for actuating the foot 1 by means of an appropriate stem-like tool, of known type and not shown for simplicity, while foot 1 is arranged at a rear panel 7. In particular, body 3 is made by coupling two half-shells 9,10 by means of screws 11 and is made by moulding a synthetic plastic material.

Foot 1 further comprises a stem 12 vertically carried by the body 3, resting means 13 on a floor 13*b* associated with a lower end 14 (FIGS. 3,4) of the stem 12 and possibly provided with a wheel 15, first screw means 16 operatively associated with the stem 12 and provided with anti-rotation means 18 cooperating with the body, a toothed wheel 19 carried by the body 3 so as to be coaxial to the stem 12 and idle about a substantially vertical symmetry axis A of the stem 12 itself, second screw means 20 operatively associated with the toothed wheel 19 and cooperating with the first screw means 16 to vertically translate the stem 12 with respect to the body 3 in response to a rotation of the toothed wheel 19, and control means 21 for the toothed wheel 19.

According to an aspect of the invention, the toothed wheel 19 is axially mounted with a clearance, of extent G, between opposite first and second abutting means of the body 3, indicated by 22 and 23, respectively. In combination, body 3 is provided with elastic axial biasing means 24 cooperating with the toothed wheel 19 and arranged at the first abutting means 22; furthermore, the latter face towards an end length 26 of the screw means 16 having a thread height H (FIG. 3) gradually decreasing towards the elastic axial biasing means 24, i.e. towards the lower end 14 of stem 12, which is free from the screw means 16.

The abutting means 23 are facing towards the floor resting means 13 and, similarly, also towards the elastic axial biasing means 24; the latter are arranged on the side opposite to the end length 26 of the first screw means 16 with respect to the lower end 14 of stem 12.

According to a preferred aspect of the invention, the elastic axial biasing means 24 directly cooperate in contact with a lower frontal face 30 of the toothed wheel (FIG. 3) and consist of at least one elastically deformable tooth 24 integrally formed in one piece with the body 3 and transversally extending so as to protrude with respect to axis A within respective seats 32 and 39 (FIG. 3) for accommodating the stem 12 and the toothed wheel 19, obtained inside the body 3, in particular half in half-shell 9 and half in half-shell 10.

The first and second abutting means consist of respective annular bottom end walls 22,23 of seat 39 for accommodating the toothed wheel 19; in particular, the seat 39 is radially obtained outside and at the seat 32 for accommodating the stem 12.

Figure 3:
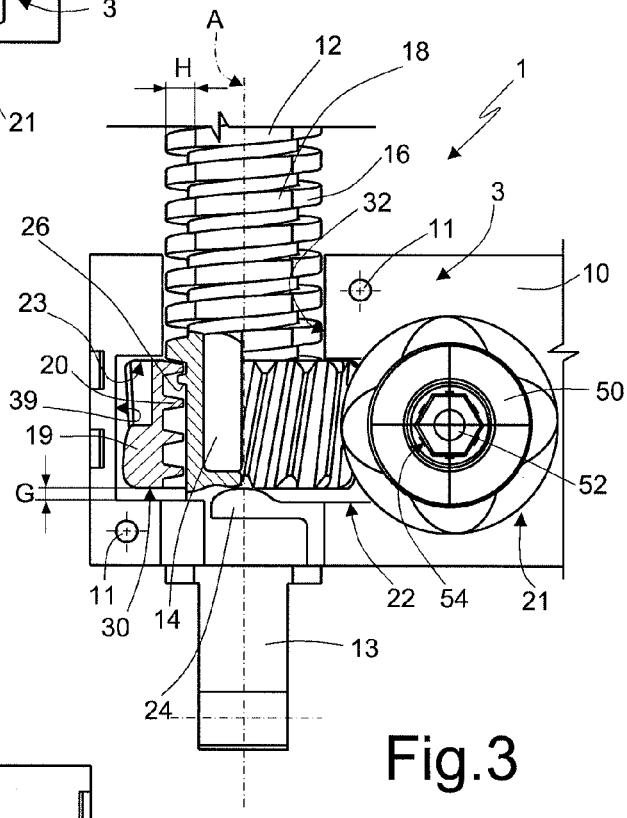
FIGS. 3 and 4 shows side elevation views of the adjustable foot in FIG. 1 with parts removed, in two different operating stroke-end configurations.

Furthermore, the at least one elastically deformable tooth 24 is shaped so that, under substantially undeformed conditions, it interferes with the toothed wheel 19 so as to keep the same substantially in contact against the second abutting means, i.e. against the bottom wall 23 of seat 39, according to the configuration shown in FIG. 3.

Figure 4:
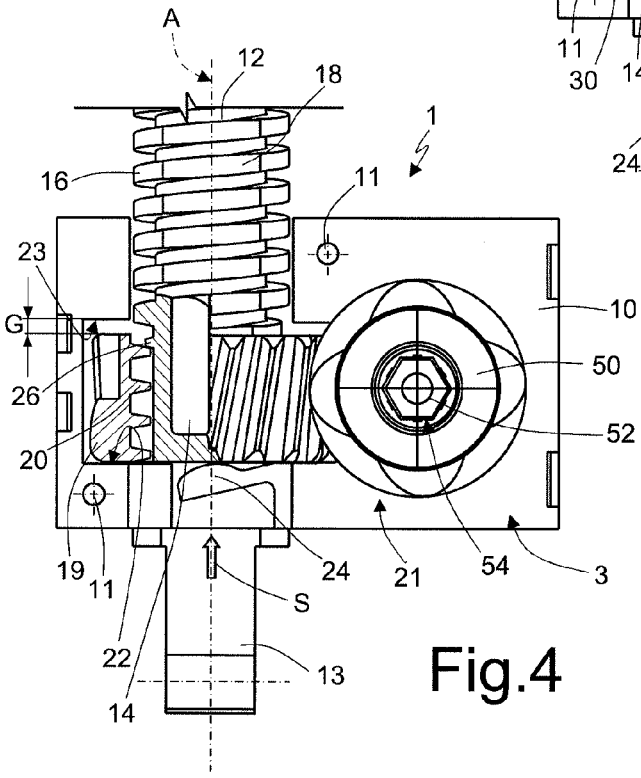

Furthermore, the at least one elastically deformable tooth 24 is adapted to take an elastically deformed position in a stroke-end configuration of stem 12, shown in FIG. 4, in which the toothed wheel 19 is in contact with the first abutting means, i.e. is abutting against the bottom wall 22 of seat 39.

Preferably, the elastic axial biasing means 24 consist of two teeth 24, each obtained in one piece for each half-shell 9,10, in a substantially tangential position with respect to the side walls of seats 32 and 39 and therebetween, according to a "fork-like" configuration, in plan view (not shown for simplicity), so that the end 14 of stem 12 may translate in use in the void therebetween, while these insist on face 30 of the toothed wheel 19.

The extent G of the axial clearance for assembling the toothed wheel 19 between the first and second abutting means 22,23 is substantially equal to the length, measured in the axial direction, of the end length 26 of the first screw means 16.

Figure 2:
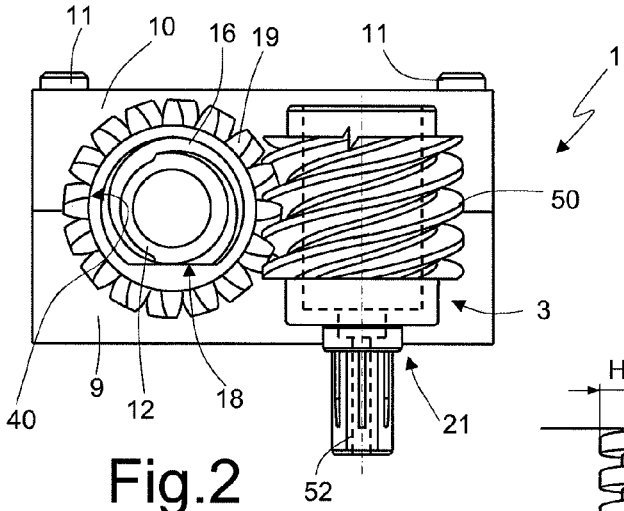
FIG. 2 is a top plan view of the adjustable foot in FIG. 1.

In this illustrated case, the first and second screw means consist of a threading 16 externally obtained on a side wall of stem 12, and a nut screw 20 obtained inside the toothed wheel 19, on a side wall of a through seat 40 thereof (FIG. 2) for coupling with stem 12, respectively.

Furthermore, the anti-rotation means consist of an axial flattening 18 obtained on the threading 16 of stem 12 which cooperates in use with a similar flattening (not shown for simplicity) inside the seat 32, otherwise cylindrical, as well as seat 39.

Finally, in the illustrated example, the control means 21 for the toothed wheel 19 consist of a worm screw 50 meshing with the toothed wheel 19, which is a helical-toothed wheel; the worm screw 50 is idly carried by the body 3 transversally to the stem 12 and by the side thereof and is provided with an axial control pin 52 projecting so as to protrude from the body 3 and provided with gripping means 54 for the mentioned stem-like tool, in this case consisting of a hexagonal prismatic head.

In use, by rotating the pin 52 by means of the aforesaid stem-like tool, introduced through the hole 6 into casing 4, the helical wheel 19 is rotated about axis A; this transmits motion to the stem 12 through the nut screw 20 which meshes with the threading 16; not being able to rotate about axis A due to the presence of the flattening 18, the stem 12 is thus forced to axially translate with respect to the body 3, sliding into the seat 32 and thus allowing the position of the floor resting means 13 to be adjusted in height.

When the electric household appliance 2 needs to be moved, the toothed wheel 19 is rotated so as to "screw" the stem 12 into the nut screw 20 and therefore lift the electric household appliance 2. Conversely, for placing the electric household appliance 2 in a fixed position, the toothed wheel 19 is rotated so as to "unscrew" the stem 12 from the nut screw 20 and then lower the electric household appliance 2.

Once the stroke-end position has been reached (maximum lifting of foot 1 with respect to the casing 2), the nut screw 20 is led into the threaded length 26 having the same height as the threads H progressively decreasing towards the end 14, until it is substantially reset. When the thread of the length 26 is completely unscrewed from the nut screw 20, the axial reaction on the toothed wheel 19 moves the same towards the wall 22, abutting against the same, straining the teeth 2, which react with an axial bias S indicated by the arrow (FIG. 4), which forces the lowered thread of the length 26 to be led into the nut screw again after a predetermined rotation of the nut screw 20 itself; therefore, the toothed wheel 19 "slips" with respect to the stem 12, alternatively moving between the positions in FIGS. 3 and 4, while the stem 12 remains axially static with respect to the body 3. Such a movement of the toothed wheel 19 requires from the user only the effort needed to elastically deform the tooth or teeth 24, which is absolutely modest.

The tapping or clicking which is caused by the axial motion of the toothed wheel 19 further informs the user that the stroke-end position with foot 1 being lifted with respect to the casing 4 has been reached.

The invention claimed is:

1. An adjustable foot for an electric household appliance, comprising:

a body integrally fastenable to a casing of the electric household appliance, a stem carried by the body so as to vertically slide, a support element associated with a lower end of the stem, a first screw mechanism operatively associated with the stem and provided with an outer portion cooperating with the body, a toothed wheel carried by the body so as to be coaxial to the stem and idle about a substantially vertical symmetry axis of the stem, a second screw mechanism operatively associated with the toothed wheel and cooperating with the first screw means for vertically translating the stem in response to a rotation of the toothed wheel, and control mechanism for the toothed wheel; wherein the toothed wheel is axially mounted with a clearance between opposite first and second abutments of the body, which is provided with axially biasing elastic element cooperating with the toothed wheel and arranged at the first abutment, the second abutment facing towards an end length of the first screw means having a thread height gradually decreasing towards the axially biasing elastic element.

2. An adjustable foot according to claim 1, wherein said second abutment is facing towards said support element and towards said axially biasing elastic element, which are arranged on the side opposite to the end length of the first screw means with respect to said lower end of the stem.

3. An adjustable foot according to claim 1, wherein said axially biasing elastic element directly contacts with a lower frontal face of the toothed wheel.

4. An adjustable foot according to claim 1, wherein said axially biasing elastic element comprises of at least one elastically deformable tooth integrally formed in one piece with said body and transversally extending so as to protrude with respect to the symmetry axis of the stem, within a first seat and a second seat for accommodating the stem and the toothed wheel, obtained inside the body.

5. An adjustable foot according to claim 4, wherein said first and second abutments each comprises a respective annular bottom end walls of the seat for accommodating the toothed wheel, which seat is radially obtained outside and at said seat for accommodating the stem, said at least one elastically deformable tooth being shaped so that, under undeformed conditions, it interferes with the toothed wheel so as to bias the same substantially in contact against the second abutment.

6. An adjustable foot according to claim 5, wherein said at least one elastically deformable tooth is adapted to take an elastically deformed position in which said toothed wheel is in contact against the first abutment.

7. An adjustable foot according to claim 1, wherein the amount of said axial clearance for mounting the toothed wheel between the first and second abutments is substantially equal to the length, measured in the axial direction, of said end length of the first screw mechanism.

8. An adjustable foot according to claim 1, wherein said first and second screw mechanisms comprise a threading externally obtained on a side wall of the stem, and a nut screw obtained inside the toothed wheel, on a side wall of a through seat thereof coupling with the stem, respectively.

9. An adjustable foot according to claim 8, wherein said outer portion comprises an axial flattening obtained on said threading of the stem.

10. An adjustable foot according to claim 1, wherein said control mechanism for the toothed wheel consist of a worm screw meshing with the toothed wheel, which is a helical-toothing wheel; the worm screw being idly carried by the body transversally to the stem and by the side thereof; said worm screw being provided with an axial control pin projecting so as to protrude from the body and provided with gripping element.

* * * * *